US006023036A

United States Patent [19]

Nichols

[11] Patent Number: 6,023,036

[45] Date of Patent: Feb. 8, 2000

[54] ELECTRICAL CONTACT WEAR AND TEMPERATURE INDICATOR

[76] Inventor: Bruce W. Nichols, 1104 Shadow Wood Trail, Desoto, Tex. 75115

[21] Appl. No.: 09/296,003

[22] Filed: Apr. 21, 1999

Related U.S. Application Data

[62] Division of application No. 08/711,196, Sep. 10, 1996, Pat. No. 5,941,370.

[51] Int. Cl.[7] ..... H01H 1/00; H01H 33/02; H01H 33/75

[52] U.S. Cl. ..... 218/91; 200/262; 218/1; 218/107; 218/146; 324/424

[58] Field of Search ..... 200/11 B, 11 C, 200/11 TC, 15, 61.4, 254, 262–270, 312; 218/1.43, 53, 57–67, 72, 74, 107, 146, 90–117; 324/424; 340/635, 638, 644; 73/29.02

[56] References Cited

U.S. PATENT DOCUMENTS

| | | | |
|---|---|---|---|
| 1,746,363 | 2/1930 | Schleicher | 200/61.4 |
| 3,398,246 | 8/1968 | Linet | 200/61.4 |
| 3,440,604 | 4/1969 | Phillips | 340/454 |
| 3,553,642 | 1/1971 | Rike et al. | 340/454 |
| 3,660,815 | 5/1972 | Rees | 340/454 |
| 3,716,832 | 2/1973 | Gorgie et al. | 340/454 |
| 3,787,651 | 1/1974 | Chabala et al. | 218/18 |
| 3,800,278 | 3/1974 | Jaye et al. | 340/454 |
| 4,016,533 | 4/1977 | Ishikawa et al. | 340/454 |
| 4,024,525 | 5/1977 | Baumgartner et al. | 340/648 |
| 4,188,613 | 2/1980 | Yang et al. | 340/454 |
| 4,298,857 | 11/1981 | Robins et al. | 340/454 |
| 4,333,095 | 6/1982 | Silva | 340/679 |
| 4,420,662 | 12/1983 | Niemeyer et al. | 200/53 |
| 4,527,022 | 7/1985 | Vazquez | 200/11 TC X |
| 4,532,499 | 7/1985 | Collin et al. | 340/644 |
| 4,536,670 | 8/1985 | Mayer | 310/249 |
| 4,562,421 | 12/1985 | Duffy | 340/454 |
| 4,620,156 | 10/1986 | Alvin et al. | 324/424 |
| 4,636,778 | 1/1987 | Corkran et al. | 340/648 |
| 5,013,876 | 5/1991 | Chabala | 200/254 |
| 5,168,260 | 12/1992 | Mery | 340/454 |
| 5,408,225 | 4/1995 | Stadelhofer | 340/686 |
| 5,420,571 | 5/1995 | Coleman et al. | 340/644 |
| 5,453,591 | 9/1995 | Stroud | 218/43 |
| 5,488,261 | 1/1996 | Swoboda et al. | 310/249 |

FOREIGN PATENT DOCUMENTS

| | | |
|---|---|---|
| 0092027 | 10/1983 | European Pat. Off. . |
| 0193732 | 3/1991 | European Pat. Off. . |
| 116530 | 11/1975 | Germany . |
| 57-125334 | 8/1982 | Japan . |

OTHER PUBLICATIONS

Wilson, Sam, *Industrial Electronics for Technicians,* TAB Books, 1994, pp. 65–73.

Mason, John R., *Switch Engineering Handbook*, McGraw–Hill, Inc., 1993, pp. 1.21–1.70.

*Primary Examiner*—J. R. Scott

*Attorney, Agent, or Firm*—Carr & Storm, L.L.P.

[57] ABSTRACT

The design of electrical switches that operate under load (with current flowing) requires replacement of the electrical contact after erosion and wear experienced by arcing and raised temperatures reduce functionality below acceptable limits.

A quantity of trace element or compound is implanted at a depth representative of the point at which wear or erosion requires contact replacement. When exposed by wear or erosion, the quantity of the trace element is released into the oil or other medium surrounding the contact, providing an indication of excessive wear.

6 Claims, 2 Drawing Sheets

ELECTRICAL CONTACT WEAR AND TEMPERATURE INDICATOR

CROSS-REFERENCE TO RELATED APPLICATION

This application is a divisional of U.S. patent application Ser. No. 08/711,196, filed Sep. 10, 1996, now U.S. Pat. No. 5,941,370, entitled ELECTRICAL CONTACT WEAR AND TEMPERATURE INDICATOR, to Bruce W. Nichols.

FIELD OF THE INVENTION

The present invention relates in general to electrical switches and in particular to electrical contact assemblies and electrical switches utilizing the same.

BACKGROUND OF THE INVENTION

The contacts of electrical switches operating under load typically erode during normal operation and even further deteriorate when overheating occurs. Erosion and overheating of the contacts can cause failures or deteriorated switch operation and otherwise generally reduce or limit the useful lives of the switches themselves. The degree of erosion or deterioration from overheating is a function of the various conditions that exist during operation, such as the amount of current carried by the contacts, the voltage applied across the contacts, the maximum operating temperature experienced, along with the severity of service under which the contacts operate (e.g. the amount and frequency of switching operations). In addition, erosion or overheating of electrical contacts can signal failure or malfunction of other switch components.

The erosion of electrical contacts most commonly results from the arcing which occurs whenever a switch breaks a circuit. An arc is formed as the electrical contacts move apart from each other and the electric potential between them causes electrons to bridge the intercontact space region. A current is maintained in the arc until the spacing between the contacts, and thus the impedance, increases enough to prevent electrons from bridging the gap for the given voltage potential. The current flowing across the gap generates heat, resulting in temperatures high enough to burn away some of the contact material. Switches may fail when their contacts have eroded so far that they cannot effectively complete a circuit.

Switches are also subject to overheating from a high resistive contact interface. Excessive heating of contacts or other switch components can less dramatically change the physical characteristics of the contacts than erosion, but nonetheless can cause significant contact deterioration and even contact failure in the long run. Among other things, overheating can cause the contacts to become brittle and/or excessively carbonized which can result in a type of failure known as a "flash-over" failure within the switch.

Electrical contacts have a useful life which is related to the extent of erosion or overheating, if it occurs. Once a contact has eroded to the point in which further use risks injury to personnel or machinery, known as the "critical point," a contact's useful life is over. The critical point is a measure of volume and is reached when, as a result of erosion for example, only a predetermined percentage of a contact remains.

Because arcing and erosion cannot be eliminated, switches are often designed to allow replacement of the contacts. It is typically less expensive to replace worn contacts than to replace an entire switch when the contacts have eroded to the critical point or close thereto. As a result however, users of switches must monitor the erosion of the contacts to recognize when the predetermined critical point is approaching or has been reached. Replacing worn contacts at or before the critical point is important because contacts used past that point continue to erode and may cause the switch to fail. A switch failure can have a negative or catastrophic effect on equipment and presents a danger to personnel. On the other hand, replacing contacts before the end of their useful life increases material and labor costs. Monitoring of the temperature to which components have been subjected is also helpful in assessing the efficiency of operation and remaining useful life of components, such as switch contacts, even before a failure such as a "flash-over" occurs.

There are four basic environments within which electrical contacts operate: (1) in air, (2) in inert gas, (3) under oil, and (4) within a vacuum. Each of these environments presents challenges to the contact monitoring process.

Air-environment contacts can be observed visually to monitor the degree of wear, allowing replacement at times appropriate to the life of the contact before the risk of failure is inordinately great. Inert gas-environment and vacuum-environment contacts usually cannot be observed visually, as they are most often contained in an opaque enclosure or vacuum bottle. Oil-environment contacts are used for medium and high voltage equipment, including circuit breakers and transformer and regulator load tap changers used by electric utilities. These contacts operate under oil in an enclosed tank or compartment, preventing easy access to the contacts. Regardless of the type of environment in which contacts and other components operate, they may be operated in some form of enclosure. For air or oil environments, this enclosure may be open to the atmosphere, but for vacuum or inert gas environments, the enclosure must be sealed. Sealed enclosures make monitoring particularly difficult.

A transformer has two sets of wire coils, known as the primary windings and the secondary windings. A voltage applied to the primary windings (known as the primary voltage) will induce a voltage in the secondary windings (known as the secondary voltage). The secondary voltage will be higher or lower than the primary voltage, depending upon the relationship of the number of turns, or coils, of wire in the primary and secondary windings of the transformer. A transformer with a greater number of coils in the secondary windings will produce a secondary voltage higher than the primary voltage. A transformer without taps, or access points, in the secondary windings will produce only one secondary voltage for each primary voltage. Many examples of transformers have numerous taps in the secondary windings so a variety of secondary voltages may be selected from one transformer. A transformer which has taps in the secondary windings will allow several secondary voltages to be accessed, depending upon which tap is selected. One transformer may be used to both decrease and increase voltage, if it is tapped at points lower and higher in number than the number of turns in the primary windings. Means known as a "coil tap selector switch" or a "load tap changer" must be provided, however, to switch between the various secondary winding taps.

A "load tap changer" is a mechanical device that moves an electrical contact to different taps within the transformer or regulator, depending on the voltage output required. In some designs, the electrical contact is moved while current is still flowing within the transformer or regulator, creating numerous instances of arcing across the load tap changer's contacts as they move from one tap position to the next. In other designs, a transfer switch is employed to transfer the current during switching. In this case, the transfer switch uses a large sacrificial contact that is designed to perform the function of making and breaking the current, and arcing occurs on the sacrificial contact.

There is a large expense associated with shutting down and opening these types of equipment to determine the extent of wear or erosion of the contacts. This expense is compounded by the necessity of removing, storing, and processing a large quantity of oil, sometimes up to 1000 gallons. Contacts are often replaced early due to the difficulty of predicting the rate of erosion from one maintenance cycle to the next. The expense of inspecting the contacts is often so great that maintenance departments invariably change the contacts during every inspection, even though the contacts may have months or more of useful life remaining. Properly matching the timing of inspection with the end of the useful life of the contacts would thus advantageously result in a cost savings.

Some of the means used previously to monitor electrical equipment performance which attempted to overcome the effort and expense required by direct physical inspection include the following:

1. Dissolved Gas Analysis (DGA)

Dissolved gas analysis is used in an oil environment. In DGA, a sample of the oil surrounding the contacts is extracted and analyzed to monitor for dissolved gases. The presence of dissolved gases is indicative of various types of problems that may be occurring within the equipment. For example, the presence of acetylene dissolved in the oil surroundings is indicative of core failure in transformers. This process lacks the precision necessary to determine the proper timing of contact replacement, as the presence of gas is neither directly related to the amount of erosion of the contacts nor an indication of the degree of contact heating.

2. Infrared Monitoring

Infrared monitoring may be used in an air, inert gas, vacuum, or oil environment. In infrared monitoring, an infrared camera is used to monitor the temperature of high voltage equipment. Temperature and resistance are directly related. As resistance to current flow through electrical equipment increases, the temperature of the equipment and its surroundings also increases. The infrared camera measures in a general sense the temperature increases and alerts the user accordingly. However, this system is insufficient because it does not measure erosion and is not sufficiently accurate to monitor the temperature of contacts or other components separately from other neighboring components within the enclosure.

There is accordingly a need to provide an electrical contact wear and heating indicator which will automatically monitor contacts and provide an indication to users that the critical point or one or more temperatures have been reached.

SUMMARY OF THE INVENTION

This invention is a contact assembly that includes a means for indication of erosion and/or heating of electrical contacts operating in an oil, air, inert gas or vacuum environment. The assembly includes a contact into which an implant containing an erosion indicator or temperature indicator has been installed. The erosion indicator is positioned as an implant at a depth corresponding to the contact's critical point, beyond which further erosion makes the contact unsuitable for use. When the contact and implant are eroded to the critical point, the erosion indicator is exposed or released to the surrounding environment where it can be detected. Alternatively, or in addition to, the erosion indicator, a temperature indicator is connected to the contact or is embedded within a recess or opening in the surface of the contact or other component. The indicator material sublimates when the component reaches a pre-selected temperature, acting as an indicator of component temperatures.

The foregoing has outlined rather broadly the features and technical advantages of the present invention so that the detailed description that follows may be better understood. Additional features and advantages of the invention will be described hereinafter which form the subject of the claims of the invention. It should be appreciated by those skilled in the art that the conception and the specific embodiments disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and form a part of the specification, illustrate the embodiments of the present invention, and, together with the description, serve to better explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

Like numbers refer to like parts throughout.

Figure 1A:
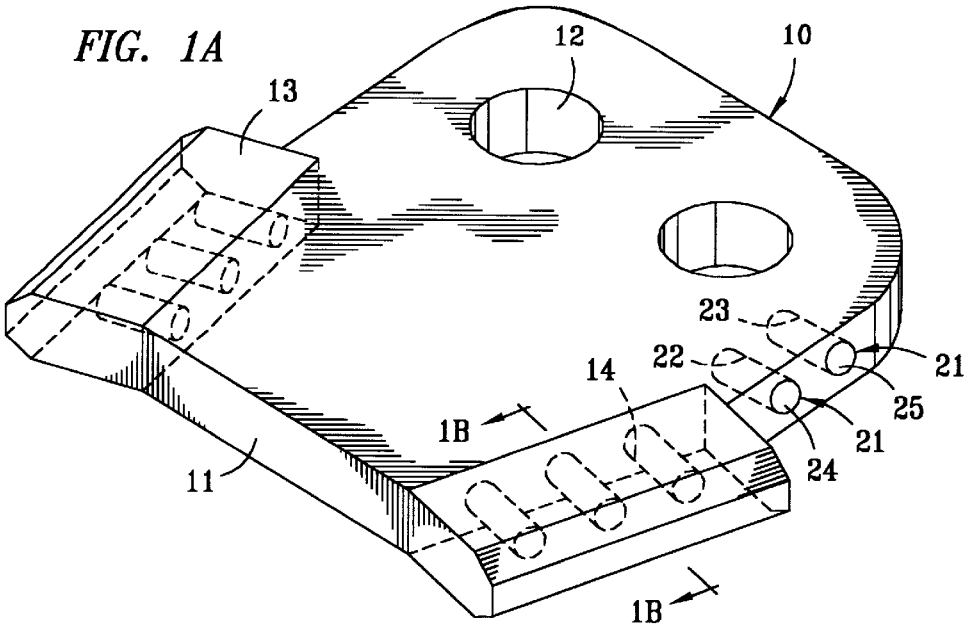
FIG. 1A is a perspective view of a combination electrical contact assembly containing an erosion indicator incorporating the invention and a temperature indicator incorporating the invention.
Figure 1B:
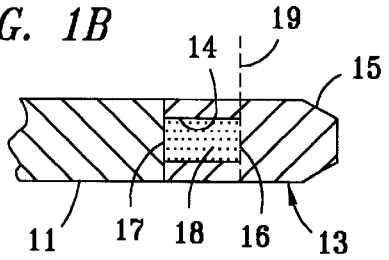
FIG. 1B is a partial section, taken along line 1B—1B of FIG. 1A, showing the construction and assembly of the erosion indicator in greater detail.

There is shown in FIGS. 1A and 1B a combination contact assembly 10 having a base 11 preferably made of copper, although any electrically conductive material may be used. Combination contact assembly 10 is used in a selector switch such as a coil tap selector or load tap changer, used with a transformer. One or more combination contact assemblies 10 is provided for each of the taps of a secondary winding. A second part of the selector switch, not shown in these figures, is used to make contact with combination contact assemblies 10, depending on the voltage required by the user. The selector switch of which combination contact assembly 10 is a part often switches between taps under load, causing arcing and erosion. Further, once combination contact assembly 10 is engaged with the second part of the switch, it continues to carry electrical current, making it susceptible to overheating. Base 11 may be provided with one or more holes 12 for mounting to the selector switch. One or more sacrificial contact tips 13 are bonded to and in electrical communication with base 11. In a preferred embodiment, sacrificial contact tips 13 are brazed to base 11.

The initial point of electrical contact between combination contact assembly and the second part of the selector switch is sacrificial contact tips 13. After the electrical circuit is completed, the point of electrical contact shifts from sacrificial contact tips 13 and is thereafter maintained in base 11. The sacrificial contact tips 13 may be of a different material than the base 11, as sacrificial contact tips 13 are subject to arcing as the electrical circuit is created and broken. A preferred embodiment of the invention is to form sacrificial contact tips 13 of a tungsten-based material specifically designed to resist erosion from arcing. Base 11 is not subject to arcing or erosion, but may fail from overheating.

Sacrificial contact tip 13 is provided with one or more cavities 14. Cavities 14 are formed in sacrificial contact tip 13, such that cavities 14 are sealed when sacrificial contact tips 13 are bonded to base 11. To allow for ease of manufacture, cavity 14 is preferably cylindrical as a result of drilling, although any shape cavity 14 may be used. Cavity 14 contains a bottom 16 which may be flat, tapered or conical, depending on the method used to form cavity 14 in sacrificial contact tip 13. After cavity 14 is provided, a trace element 18 is inserted into cavity 14, and sacrificial contact tip 13 is bonded to base 11.

As combination contact assembly 10 is used, sacrificial contact tips 13 erode from arcing. When sacrificial contact tips 13 are eroded to a sufficient degree, cavity 14 is opened.

Referring now to FIG. 1B, sacrificial contact tip 13 is shown as a cutaway along line 1B—1B of FIG. 1A. A partial representation of base 11 is shown. Sacrificial contact tip 13 has a front edge 15, which is preferably beveled. Front edge 15 is the first part of sacrificial contact tip 13 to touch the second part of the selector switch when the switch closes, and it is the last part of sacrificial contact tip 13 to separate from the opposite contact when the switch opens. As such, front edge 15 is the surface of sacrificial contact tip 13 which is most subject to erosion from arcing.

Sacrificial contact tip 13 is designated as having a critical point 19. Critical point 19 is the point at which sacrificial contact tip 13 may no longer be used, because of the extent of erosion that has occurred. As sacrificial contact tip 13 nears the end of its useful life, the distance between bottom 16 and front edge 15 decreases. As sacrificial contact tip 13 reaches the end of its useful life and front edge 15 erodes to critical point 19, bottom 16 erodes and cavity 14 is opened.

The selector switch, load tap changer, or coil tap selector in which combination contact assembly 10 is used may be installed in some form of container or enclosure, not shown in these figures. Air-environment contacts are typically installed in an enclosure for safety reasons and may be visually inspected for erosion if the enclosure is opened. Inert gas environment contacts must be installed in some form of sealed enclosure to contain the inert gas. These enclosures may be opened if the user is willing to re-fill them with a new supply of inert gas. The gas may be pressurized or at a lower pressure than the atmosphere, if the enclosure is suitably designed. Contacts that are operated in a vacuum must be installed in a sealed enclosure to preserve the vacuum. Contacts operated in oil do not have to be in a sealed environment, but the enclosure must be of sufficient design to retain a quantity of oil.

As cavity 14 is opened, trace element 18 comes into communication with and is dispersed into the environment surrounding combination contact assembly 10. When the presence of trace element 18 is detected by the detection means appropriate with the environment in which combination contact assembly 10 is operated, replacement of either sacrificial contact tip 13 or combination contact assembly 10 is indicated.

Trace element 18 is preferably composed of magnesium sulfate. Detection of dispersion of trace element 18 within the oil, air, inert gas or vacuum surrounding combination contact assembly 10 can be accomplished using existing spectrophotometric chromatography techniques or using electrochemical transducers. These means of detecting trace element 18 may be employed remotely, in a manner similar to DGA testing, in which the contents of the enclosure surrounding combination contact assembly 10 are periodically sampled and tested by either of the foregoing or other equivalent techniques for the presence of trace element 18. Alternatively, electrochemical transducers could be mounted within the enclosure in substantially continuous contact with the contents of the enclosure, allowing either a remotely or locally situated detector operatively connected to the transducers to signal detection of the presence of trace element 18.

After an electrical circuit is completed by sacrificial contact tip 13, the circuit may be maintained by moving base 11 into a position in which current is directed to flow through it instead of through the sacrificial contact. In such arrangement, base 11 is subject to overheating.

Accordingly, base 11 of combination contact assembly 10 may be provided with one or more recesses. To allow for ease of manufacture, the recess is preferably cylindrical as a result of drilling, although any shape recess may be used. A preferred embodiment of the invention is to provide a primary recess 22 and a secondary recess 23. Contained by primary recess 22 and secondary recess 23 are indicator materials 24, 25 capable of detection in a manner similar or equivalent to the detection of trace element 18. Indicator materials 24, 25 may also be placed in separate containers to be attached by riveting or otherwise to base 11.

Indicator materials 24, 25 are preferably ceramic-based and formulated or selected such that substantially all of the quantity contained in recesses 22 and 23 will transform from a solid to the liquid phase at a preselected temperature to be detected. Once in the liquid phase, indicator materials 24, 25 will diffuse into the immediately surrounding environment. When the presence of indicator materials 24, 25 is detected by the detection means appropriate with the environment in which combination contact assembly 10 is operated, replacement or shutdown of combination contact assembly 10 is indicated.

In accordance with one embodiment of the invention, primary recess 22 is filled with an indicator material 24 having a melting point of 200° F., and secondary recess 23 is filled with an indicator material 25 having a melting point of 350° F. Detection of the presence of indicator material 24 from primary recess 22 would thus indicate that base 11 of combination contact assembly 10 had reached the preselected temperature of 200° F. in operation. Subsequent or contemporaneous detection of indicator material 25 from secondary recess 23 would indicate that base 11 of combination contact assembly 10 had reached the preselected temperature of 350° F. in operation as well. Additional and alternative temperatures could be selected if desired, by the selection of different indicator materials 24, 25 with higher or lower melting points. Additional or fewer recesses 21 could also be provided, or base 11 of combination contact assembly 10 may include pairs of primary recesses 22 and secondary recesses 23. Indicator materials may also be placed into containers which are then attached to base 11.

Figure 2A:
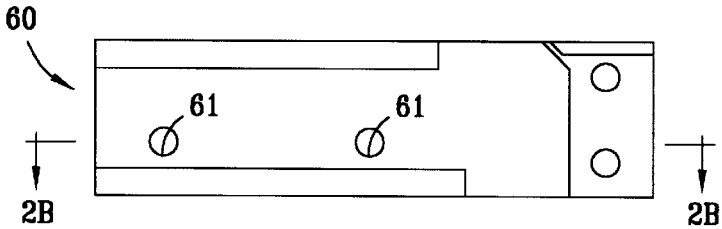
FIG. 2A is a top view of a sacrificial contact containing an erosion indicator incorporating the invention.
Figure 2B:
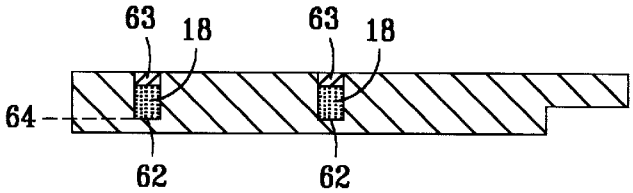
FIG. 2B is a partial section, taken along line 2B—2B of FIG. 2A, showing the construction and assembly of the erosion indicator in greater detail.

Turning now to FIGS. 2A and 2B, another embodiment of a sacrificial contact is shown. Sacrificial contact 60 is used in a high voltage switch to make and break electrical circuits, and is accordingly subject to arcing and erosion. Sacrificial contact 60 is provided with one or more cavities 61. To allow for ease of manufacture, cavity 61 is preferably cylindrical as a result of drilling, although any shape cavity 61 may be used. Cavity 61 contains a bottom 62 which may be flat, tapered or conical, depending upon the method used to form cavity 61 in sacrificial contact 60. After cavity 61 is provided, a trace element 18 is inserted into cavity 61, and cavity 61 is sealed with plug 63.

As sacrificial contact 60 is used to create and break electrical circuits, erosion occurs. When sacrificial contact 60 is eroded to a sufficient degree, cavity 61 is opened.

Referring now to FIG. 2B, sacrificial contact 60 is shown as a cutaway along line 2B—2B of FIG. 2A. Sacrificial contact 60 is designated as having a critical point 64. As sacrificial contact 60 nears the end of its useful life, the distance between bottom 62 and the surrounding material decreases. As sacrificial contact 60 erodes to critical point 64 and reaches the end of its useful life, bottom 62 erodes and cavity 61 opens.

Figure 3A:
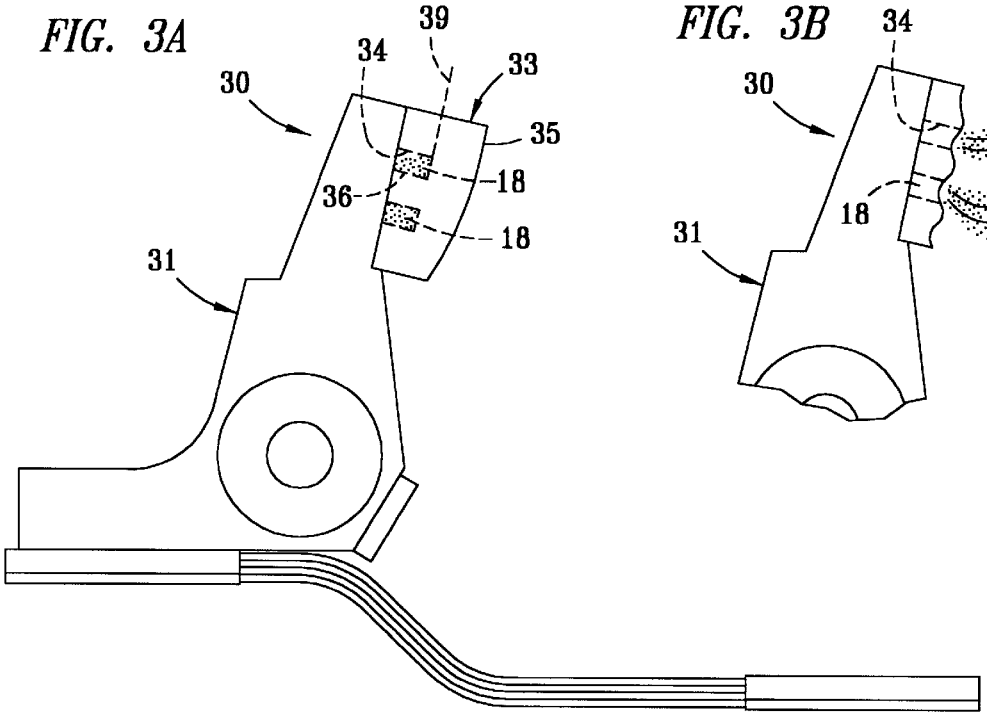
FIG. 3A is a side view of a transfer switch sacrificial contact assembly containing an erosion indicator incorporating the invention.
Figure 3B:
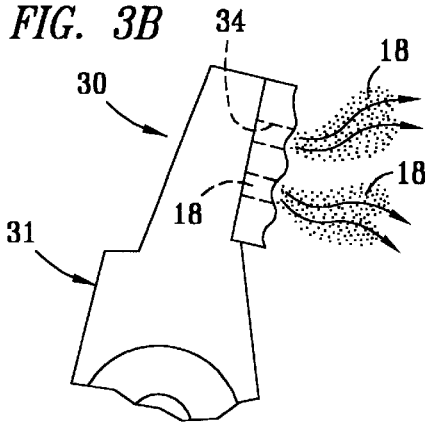
FIG. 3B is a side view of a portion of the transfer switch sacrificial contact assembly depicted in FIG. 3A, showing the emission of a trace material upon erosion of the contact.

Turning now to FIGS. 3A and 3B, another embodiment of a sacrificial contact, used as a transfer switch, is shown as sacrificial contact assembly 30. Sacrificial contact assembly 30 has a base 31 which may be made of copper, brass or any other electrically conductive material. One or more sacrificial contact tips 33 is bonded to base 31. Sacrificial contact tip 33 is provided with one or more cavities 34. Cavities 34 are formed in sacrificial contact tip 33 such that cavities 34 are sealed when sacrificial contact tips 33 are bonded to base 31. Cavity 34 is preferably cylindrical as a result of drilling, although any shape cavity 34 may be used. Cavity 34 contains a bottom 36, which may be flat or tapered, depending upon the method used to form cavity 34 in sacrificial contact tip 33. After cavity 34 is provided, a trace element 18 is inserted into cavity 34, and sacrificial contact tip 33 is bonded to base 31. Sacrificial contact tip 33 is further provided with a front edge 35 and a critical point 39.

As sacrificial contact assembly 30 is used to make and break electrical circuits, sacrificial contact tips 33 erode from arcing. When sacrificial contact tips 33 are eroded to a sufficient degree, cavity 34 is opened.

Referring now to FIG. 3B, a partial representation of sacrificial contact assembly 30 is shown. Front edge 35 of sacrificial contact tip 33 has eroded beyond critical point 39, eroding bottom 36 and opening cavity 34. As a result, trace element 18 has dispersed into the environment surrounding sacrificial contact assembly 30.

Figure 4A:
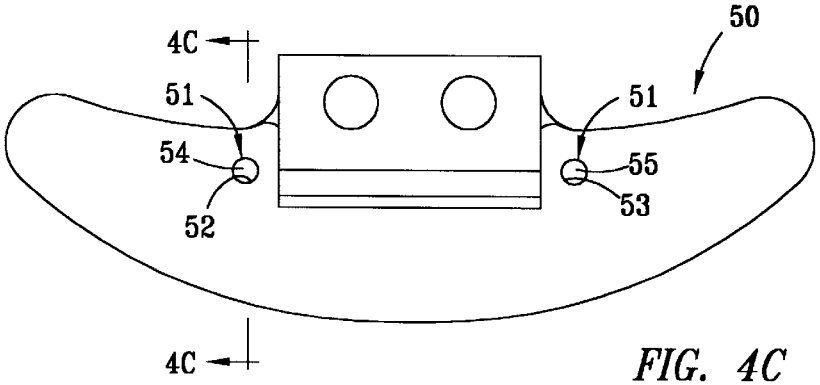
FIG. 4A is a front view of an electrical contact containing a temperature indicator incorporating the invention.
Figure 4B:
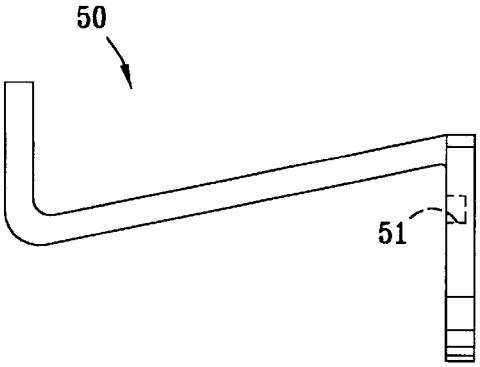
FIG. 4B is a side view of the electrical contact of FIG. 4A.
Figure 4C:
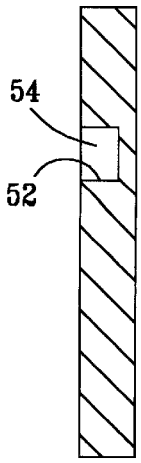
FIG. 4C is a partial section, taken along line 4C—4C of FIG. 4A, showing the construction and assembly of the temperature indicator in greater detail.

Referring now to FIGS. 4A through 4C, contact 50 is shown. Contact 50 is suitable for use in a reversing switch. A reversing switch is part of a high voltage switch that continuously carries load during operation and is therefore subject to overheating and not arcing and erosion. Although not depicted in these figures, in operation, sacrificial contact assembly 30 or sacrificial contact 60 is operatively and electrically connected to a contact element such as contact 50 by well known means. Contact 50 is provided with one or more recesses 51. To allow for ease of manufacture, the recess is preferably cylindrical as a result of drilling, although any shape recess may be used. A preferred embodiment of the invention is to provide a primary recess 52 and a secondary recess 53. Contained by primary recess 52 and secondary recess 53 are indicator materials 54, 55 capable of detection in a manner similar or equivalent to the detection of trace element 18 as previously discussed, as contact 50 is used in an oil, inert gas, air or vacuum environment such as used for combination contact assembly 10. Indicator materials 54, 55 may also be placed in separate containers to be attached by riveting or otherwise to contact 50.

Indicator materials 54, 55 are preferably ceramic-based and formulated or selected such that substantially all of the quantity contained in the respective recesses 52 and 53 will transform from a solid to the liquid phase at a selected temperature to be detected. Contact 50 is therefore preferably contained in oil, to allow ready diffusion of indicator materials 54, 55 from contact 50. Once in the liquid phase, indicator materials 54, 55 will diffuse into the immediately surrounding oil environment. Other operating environments may be used upon selection of the proper indicator materials 54, 55 and detection means. When the presence of indicator materials 54, 55 is detected by the detection means appropriate with the environment in which contact 50 is operated, replacement or shutdown of the switch within which contact 50 operates is indicated.

In accordance with one embodiment of the invention, primary recess 52 is filled with an indicator material 54 having a melting point of 200° F., and secondary recesses 53 are filled with an indicator material 55 having a melting point of 350° F. Detection of the presence of indicator material 54 from primary recess 52 would thus indicate that contact 50 had reached the preselected temperature of 200° F. in operation. Subsequent or contemporaneous detection of indicator material 55 from secondary recess 53 would indicate that contact 50 had reached the preselected temperature of 350° F. in operation as well. Additional and alternative temperatures could be preselected, if desired, by the selection of different indicator materials 54, 55 with higher or lower melting points. Additional or fewer recesses 51 could also be provided. Indicator materials 54, 55 may also be placed into containers which are attached to contact 50.

Turning now to FIG. 4C, contact 50 is shown as a cutaway along line 4C—4C of FIG. 4A. Primary recess 52 is shown as filled with indicator material 54.

It will be apparent that the erosion and temperature detection means described with reference to the figures described above could be used in combination contact assembly 10 or in the combination of sacrificial contact assembly 30 or sacrificial contact 60 electrically connected to contact 50.

Although the present invention and its advantages have been described in detail, it should be understood that various changes, substitutions and alterations can be made herein without departing from the spirit and scope of the invention as defined by the appended claims.

What is claimed is:

1. A method for determining when an electrical contact assembly operating within an oil environment and having at least one sacrificial contact tip mounted to a conductive base requires replacement, the method comprising:

defining a cavity within the at least one sacrificial contact tip;

providing a trace element within said at least one cavity;

allowing said at least one sacrificial contact to be eroded until an opening is formed in said at least one sacrificial contact;

permitting said trace element to disperse from said cavity through said opening into said oil environment; and monitoring said oil environment to determine when a sufficient quantity of trace element has dispersed into the oil environment to indicate that said electrical contact assembly requires replacement.

2. The method of claim 1 wherein the step of monitoring further comprises using dissolved gas analysis (DGA) to identify when a sufficient quantity of trace element has dispersed into said oil environment to indicate that said electrical contact assembly requires replacement.

3. The method of claim 1 wherein the step of monitoring further comprises using infrared monitoring to identify when a sufficient quantity of trace element has dispersed into said oil environment to indicate that said electrical contact assembly requires replacement.

4. The method of claim 1 wherein said trace element comprises magnesium sulfate.

5. The method of claim 1 wherein the at least one sacrificial contact tip comprises a material resistant to erosion from arcing.

6. The method of claim 1 wherein the at least one sacrificial contact tip comprises a tungsten-based material resistant to erosion from arcing.

* * * * *